US007287562B2

(12) United States Patent
Tanikawa et al.

(10) Patent No.: US 7,287,562 B2
(45) Date of Patent: Oct. 30, 2007

(54) FILLING VALVE

(75) Inventors: Katsunori Tanikawa, Ishikawa-ken (JP); Shinya Kamori, Ishikawa-ken (JP); Futoshi Konishi, Ishikawa-ken (JP); Kenichi Tsukano, Ishikawa-ken (JP)

(73) Assignee: Shibuya Kogyo Co., Ltd., Kanazawa-shi, Ishikawa-ken (JP)

( * ) Notice: Subject to any disclaimer, the term of this patent is extended or adjusted under 35 U.S.C. 154(b) by 121 days.

(21) Appl. No.: 11/057,982

(22) Filed: Feb. 15, 2005

(65) Prior Publication Data

US 2005/0178466 A1 Aug. 18, 2005

(30) Foreign Application Priority Data

Feb. 16, 2004 (JP) ..... 2004-038794

(51) Int. Cl.
*B65B 1/04* (2006.01)

(52) U.S. Cl. ..... 141/367; 141/39

(58) Field of Classification Search ..... 141/39, 141/286, 367

See application file for complete search history.

(56) References Cited

U.S. PATENT DOCUMENTS 3,455,350 A * 7/1969 Hinxlage ..... 141/367
4,674,547 A 6/1987 Simonazzi
6,155,314 A * 12/2000 Ding et al. ..... 141/285

FOREIGN PATENT DOCUMENTS

JP 2002-370797 12/2002

OTHER PUBLICATIONS

European Search Report dated Apr. 25, 2005 (3 pages).

* cited by examiner

*Primary Examiner*—Steven O. Douglas
(74) *Attorney, Agent, or Firm*—Flynn, Theil, Boutell & Tanis, P.C.

(57) ABSTRACT

A vessel mouth gasket unit is fitted around the outer periphery of a valve body which is internally formed with a filled liquid passage. A first gasket having a smaller diameter and a second gasket having a larger diameter is mounted on the lower surface of the unit. The filling valve is made up of a liquid valve opening and closing air cylinder which opens and closes a liquid valve 8 disposed in the filled liquid passage, and a vessel mouth gasket auxiliary air cylinder which urges the unit downward. The valve body has an outer diameter which is greater than the aperture diameter of a bottle-like first type vessel and less than the aperture diameter of a second type vessel having a larger aperture. The operating pressure of the auxiliary air cylinder is controllable and the filling operation takes place by urging the gasket against the first vessel with a low load and by urging the gasket against the second type vessel with a high load. The filling valve enables a combined use for filling the bottle-like first type vessel B and the second type vessel without requiring a replacement of parts.

4 Claims, 4 Drawing Sheets

FILLING VALVE

BACKGROUND OF THE INVENTION AND RELATED ART STATEMENT

The present invention relates to a liquid filling valve which is used to fill a liquid into a vessel while the interior of the vessel is sealed, and in particular, to a filling valve employed in a filler which can be selectively used with a bottle-like vessel of a smaller mouth aperture (referred to hereafter as a first type vessel) such as a vessel or bottle which-can be resealed with a cap as exemplified by a PET bottle and also with a vessel having a larger aperture such as a canister (hereinafter referred to as a second type vessel).

Generally a filler is provided with a filling valve which comprises a filled liquid passage formed within a valve body, and a liquid valve which opens or closes the filled liquid passage. By opening the liquid valve, the liquid to be filled is injected into the vessel through the filled liquid passage. When the filler is used to fill a carbonic acid gas-charged beverage into a vessel, it is necessary to seal a top opening of the vessel and accordingly, a centering guide which guides the top opening of the vessel and a gasket which seals the top opening are used in bringing the gasket into abutment under pressure against the full periphery of the top opening of the vessel in order to seal the interior of the vessel while the beverage is being filled.

The bottle-like first type vessel and the second type vessel, such as a canister, have different aperture diameters for a mouth or top opening. Accordingly, when a filler of the type as mentioned above in which a filling operation takes place by sealing the mouth of the vessel is to be selectively used with both types of vessels, the gasket which seals the interior of the vessel and the centering guide must be changed depending on the type of vessels.

Accordingly, in order to allow the filler to be selectively used with vessels with different mouth apertures, there is proposed a combined use filling valve (see US Patent No. 3,455,350) including a first gasket which is adapted to be disposed in abutment against the mouth of the first type vessel of a smaller mouth aperture, such as a bottle, and a second gasket which is adapted to be disposed in abutment against the mouth of the second type vessel of a larger aperture, such as a can. In the arrangement of this patent, when the type of the vessel is changed, there is no need to change a cylindrical member on which a gasket is mounted, and it is only necessary to change a vent tube.

In the arrangement of the cited patent, when the second type vessel of a larger aperture, such as a canister, is to be filled, in particular, when a canister having a reduced wall thickness is to be filled, it is to be noted that there arises a problem that an imbalance between a force applied from a filling valve and a force from the vessel prevents a seal from being successfully achieved because the aperture of the canister which is sealed by the gasket associated with the canister is greatly different from the aperture of the filling valve. In addition, if the gasket is forcibly urged against the vessel in order to achieve a reliable seal, there occurs a deformation of the vessel.

To cope with this problem, the inventors of the present Application have previously filed a Patent Application for a filling valve which allows a combined use with the bottle-like first type vessel and a second type vessel having a larger aperture, such as a can, and which is capable of achieving a balance between the force from the vessel and the force from the filling valve during the filling operation without requiring a replacement of parts as the vessel type is changed (see Japanese Laid-Open Patent Publication No. 2002-370,797).

The arrangement of a filling valve disclosed in the cited Application will be described briefly below with reference to FIGS. 4A and 4B. A filling valve 101 includes a valve body 102 in which a filled liquid passage 104 is formed, which is opened and closed by a liquid valve 108. The liquid valve 108 comprises a valve element 112 formed on the bottom end of a rod 110 which is inserted into the filled liquid passage 104 in an elevatable manner, and a valve seat 114 formed on the internal surface of the filled liquid passage 104 at the bottom thereof.

In order to achieve a suitable load when sealing the mouth of a vessel when filling into the bottle-like first type vessel B and the second type vessel C having a larger opening aperture, the valve body 102 of the filling valve 101 is formed with a larger diameter portion 102*a* and a smaller diameter portion 102*b*, and a vessel mouth gasket unit 132 is correspondingly formed with a larger diameter portion 132*a* and a smaller diameter portion 132*b* which fit around the larger diameter portion 102*a* and the smaller diameter portion 102*b*, respectively. A first seal member 134 which seals between the larger diameter portions 102*a* and 132*a* and a second seal member 136 which seals between the smaller diameter portions 102*b* and 132*b* are provided, and a first gasket 138 which substantially matches the aperture diameter of the bottle-like first type vessel B and a second gasket 140 which substantially matches the aperture diameter of the second type vessel C, such as a canister, are amounted on the bottom surface of the vessel mouth gasket unit 132. For the first type vessel B, a filling operation takes place by bringing the smaller diameter portions 102*b* and 132*b* into fitting engagement (see FIG. 4A) while for the second type vessel C, a filling operation takes place while removing the smaller diameter portions 102*b* and 132*b* from each other (see FIG. 4B).

In a conventional arrangement, when filling the bottom-like first type vessel B, there has been a need to provide a gas passage 152 which communicates with a space 156 (see FIG. 4A) defined between the first seal member 134 and the second seal member 136 as well as a valve, not shown, which operates to open or close the passage 152 in order to allow a flow of the air into and out of the space 156 during the elevating motion of the vessel mouth gasket unit 132. In addition, the gas passage 152 needs to be cleaned, resulting in complicating the structure.

OBJECT AND SUMMARY OF THE INVENTION

Accordingly, it is an object of the present invention to provide a filling valve capable of a combined use with vessels of different aperture diameters while retaining a simple structure.

The above object is accomplished by providing a filling valve for combined use with the first and the second type vessels comprising a valve body internally formed with a filled liquid passage, a liquid valve for opening and closing the filled liquid passage, a vessel mouth gasket unit fitted around the outer periphery of the valve body in an elevatable manner, a seal member which seals between the valve body and the vessel mouth gasket unit, and a gasket on the vessel mouth gasket unit and disposed for abutment against the mouth of either the first type vessel having a smaller aperture and the second type vessel having a larger aperture wherein, the outer diameter of the valve body is chosen to be greater than the aperture diameter of the first type vessel and less than the aperture diameter of the second type vessel, further comprising an air cylinder for urging the vessel mouth gasket unit downward, the arrangement being such that when a second type vessel is to be filled, the air cylinder urges the vessel mouth gasket unit with a greater force than for the first type vessel.

The filling valve according to the present invention has a simple structure while allowing a filling operation to be performed with a required minimum load on the mouth and barrel of the bottle-like first type vessel having a smaller aperture diameter and the second type vessel having a larger aperture diameter, such as a canister, and thus can be selectively used with an aluminum canister of a reduced wall thickness and an aluminum bottom or the like.

DETAILED DESCRIPTION OF THE PREFERRED EMBODIMENT

Figure 1:
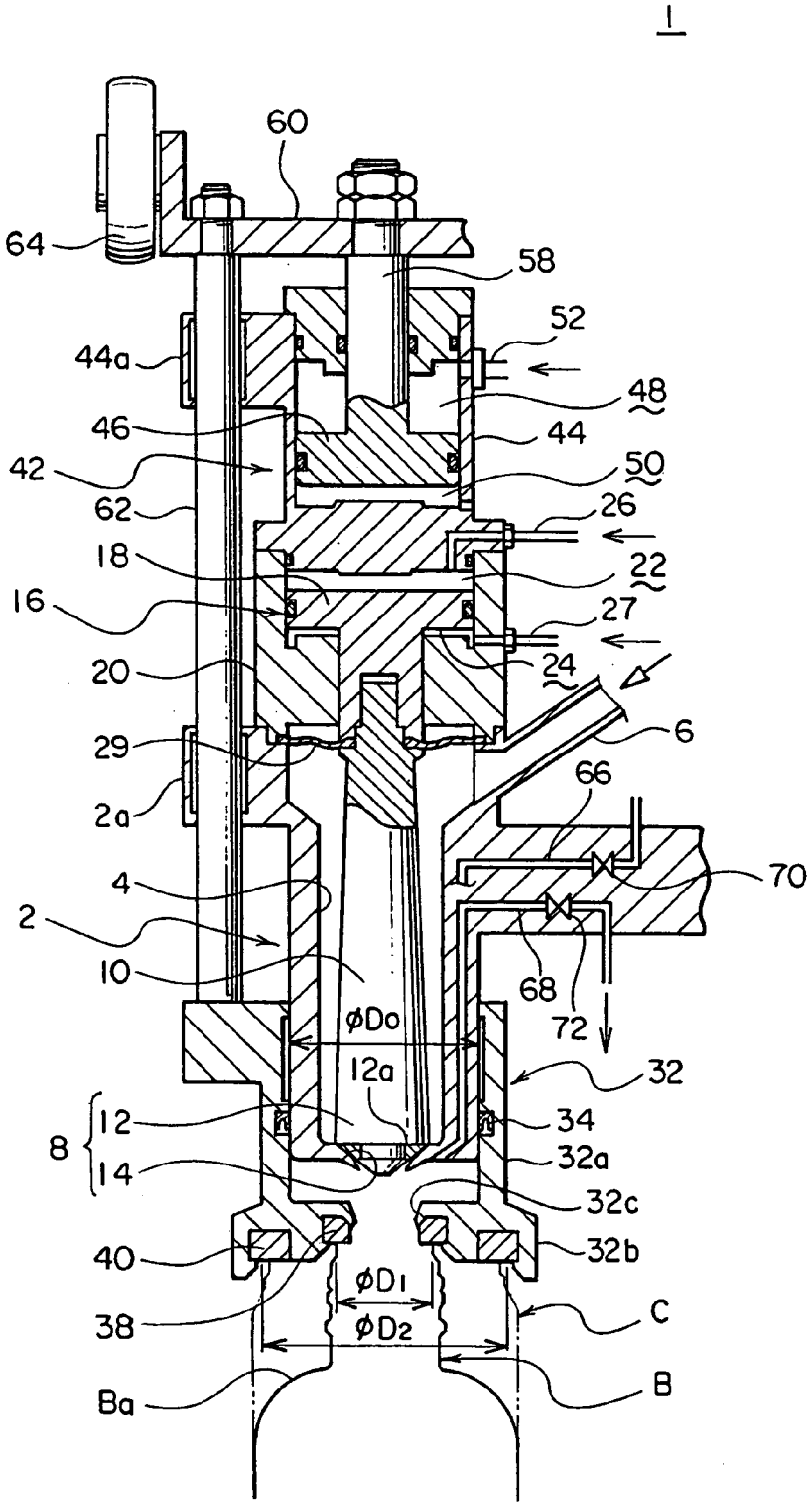
FIG. 1 is a longitudinal section of a filling valve according to an embodiment of the present invention.
Figure 2:
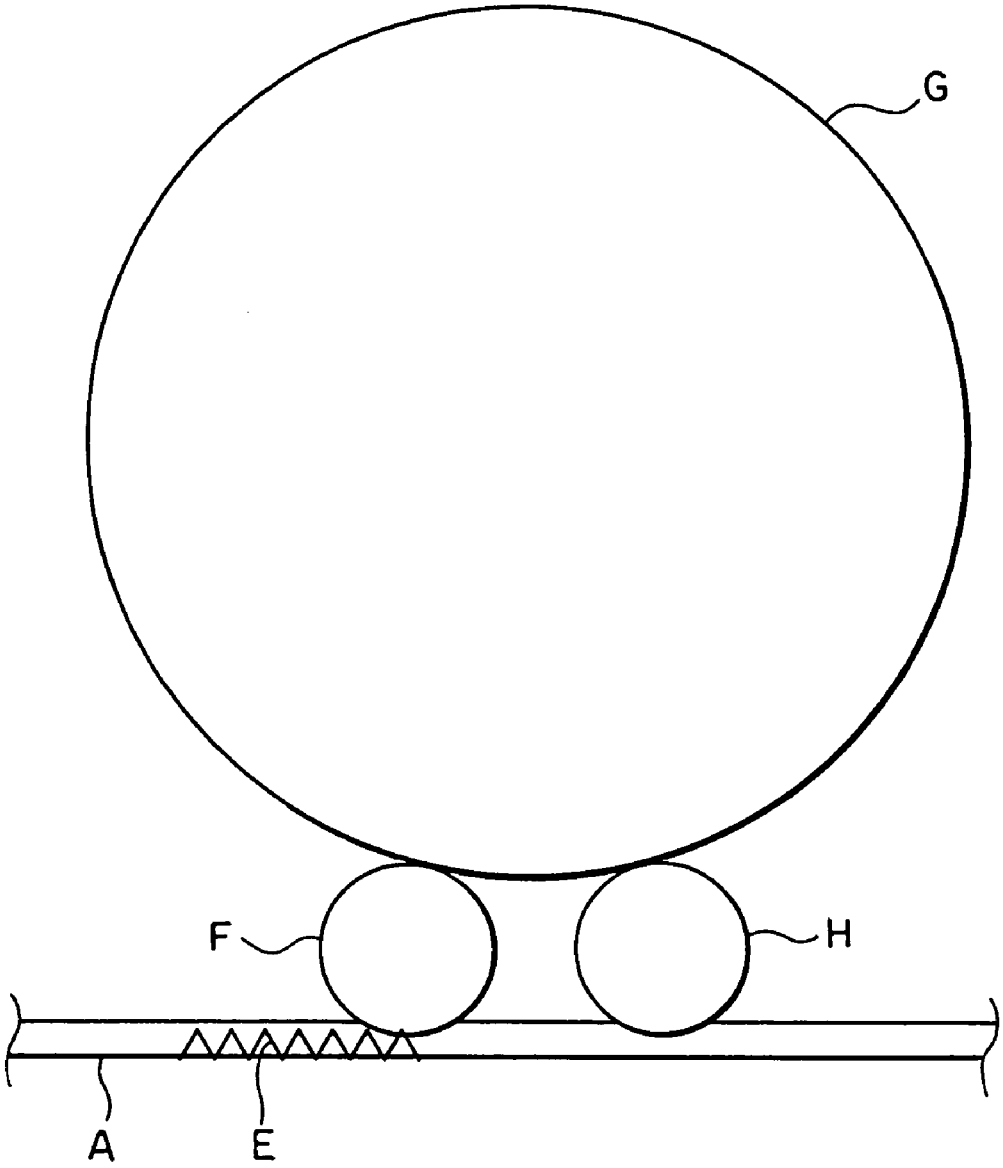
FIG. 2 is a plan view schematically illustrating the overall arrangement of a rotary filler which includes the filling valve.

An embodiment of the present invention will now be described with reference to the drawings. Referring to FIG. 2, vessels B or C which are conveyed by a vessel conveyor A (FIG. 1 indicates two type of vessels concurrently) are separated into a given interval by an in-feed screw E, and delivered onto a rotary filler G through an inlet star wheel F. A liquid is filled into each vessel B or C by the filling valve 1 during the time it is rotatively conveyed by the filler G, and it is then discharged onto the vessel conveyor A by an outlet star wheel H to be fed to a succeeding step.

It is to be understood that the rotary filler G includes a revolving body and a plurality of filling valves 1 are disposed at a given circumferential interval along the outer periphery thereof. One of the filling valves 1 is disposed in vertical alignment with one of the vessels B or C which are located therebelow, and a filling operation takes place while both filling valves and the vessels rotate in an integral manner.

The construction of the filling valve 1 will now be described with reference to FIG. 1. The filling valve 1 comprises a valve body 2, in which a filled liquid passage 4 is formed, and a filled liquid which is fed from a tank 5 of a filled liquid (see FIG. 3) through a liquid feed pipe 6 passes through the filled liquid passage 4 to be filled into the vessel B or C. The vessel B shown in FIG. 1 represents a vessel which can be resealed with a cap after opening it, such as a PET bottle, or a vessel of a smaller mouth aperture and having a shoulder Ba, such as a normal glass bottle, and vessels B of such type are referred to herein as a first type vessel. The vessel C represents a vessel having a larger aperture and which is not provided with a shoulder, such as a canister, and is referred to herein as a second type vessel.

A liquid valve 8 which opens and closes the filled liquid passage 4 is disposed within the valve body 2. The liquid valve 8 comprises a valve element 12 formed on the bottom end of a rod 10 which is inserted into the filled liquid passage 4 in an elevatable manner, and a valve seat 14 formed on the internal surface of the filled liquid passage 4 at the bottom thereof. In a region where the valve element 12 is seated on the valve seat 14, the outer peripheral surface of the valve body 2 is fitted with a seal member 12*a* to maintain a liquid tightness when the valve is closed. The rod 10 which carries the valve element 12 can be moved up and down by an air cylinder 16 disposed in an upper region within the valve body 2 which is used to open or close the liquid valve.

A piston (liquid valve opening and closing piston) 18 is connected to the upper end of the rod 10, and is slidably fitted inside a first cylinder housing 20 which is secured to the top of the valve body 2, thus dividing the internal space of the cylinder housing into an upper and a lower pressure chamber 22 and 24. The pressure chambers 22 and 24 are connected to a source of air pressure, not shown, through air passages 26 and 27, respectively, to allow pressurized air to be introduced into a pressure chamber 22 or 24 or to make them open to the atmosphere. When the pressurized air is introduced into the upper air chamber 22, the rod 10 moves down together with the liquid valve opening and closing piston 18 to cause the valve element 12 to be seated on the valve seat 14, thereby closing the filled liquid passage 4. On the other hand, when the pressurized air is introduced into the lower pressure chamber 24, the rod moves up to move the valve element 12 away from the valve seat 14 to open the filled liquid passage 4, thus allowing a filling operation to take place.

A flowmeter 28 (see FIG. 3) is disposed within the liquid feed pipe 6 to determine the flow rate, and when it is determined that a given amount of filled liquid has passed, a signal from the flowmeter 28 causes a controller, not shown, to drive the rod 10 and the valve element 12 down to close the liquid valve 8, thus terminating a filling operation. It is to be noted that a diaphragm 29 is interposed between the filled liquid passage 4 within the valve body 2 and the liquid valve opening and closing air cylinder 16 which is disposed thereabove to provide an interruption therebetween.

A cylindrical vessel mouth gasket unit 32 is fitted around the outer periphery of the valve body 2 at its bottom. The vessel mouth gasket unit 32 includes a cylindrical portion 32*a* having an integral diameter which substantially matches the outer diameter D0 of the valve body 2, and a bottom 32*b* which is disposed at the lower end of the cylindrical portion 32*a*. The bottom 32*b* is centrally formed with a passage opening 32*c* which has an internal diameter slightly less than the aperture diameter D1 of the bottle-like first type vessel B. A seal member 34 is fitted in a portion of the vessel mouth gasket unit 32 which slides along the outer surface of the valve body 2 to maintain a hermetic seal between the internal surface of the vessel mouth gasket unit 32 and the outer surface of the valve body 2. The outer diameter D0 of the valve body 2 and the internal diameter of the cylindrical portion 32*b* of the vessel mouth gasket unit 32 which slides along the outer portion of the valve body 2 are greater than the aperture diameter D1 of the first type vessel B and less than the aperture diameter D2 of the second type vessel C.

A vessel mouth gasket (first gasket) 38 for a bottle which has a diameter substantially matching the aperture diameter D1 of the first type vessel (bottle-like vessel) B which is to be filled by the filler G provided with the filling valve 1 and a vessel mouth gasket (second gasket) 40 for a canister which has a diameter substantially matching the aperture diameter D2 of the second type vessel (a canister type vessel such as a can) C are fitted into the lower surface of the vessel mouth gasket unit 32. The vessel mouth gasket unit 32 is adapted to be elevated by a vessel mouth gasket auxiliary air cylinder 42 which is mounted above the liquid valve opening and closing cylinder 16 which is mounted on top of the valve body 2. When the vessel B or C is to be filled, the vessel mouth gasket unit 32 is driven down by the action of the vessel mouth gasket auxiliary air cylinder 42 to bring either one of the vessel mouth gaskets 38 or 40 into close contact with the mouth of a corresponding one of the vessel B or C, thus sealing the vessel B or C.

Figure 3:
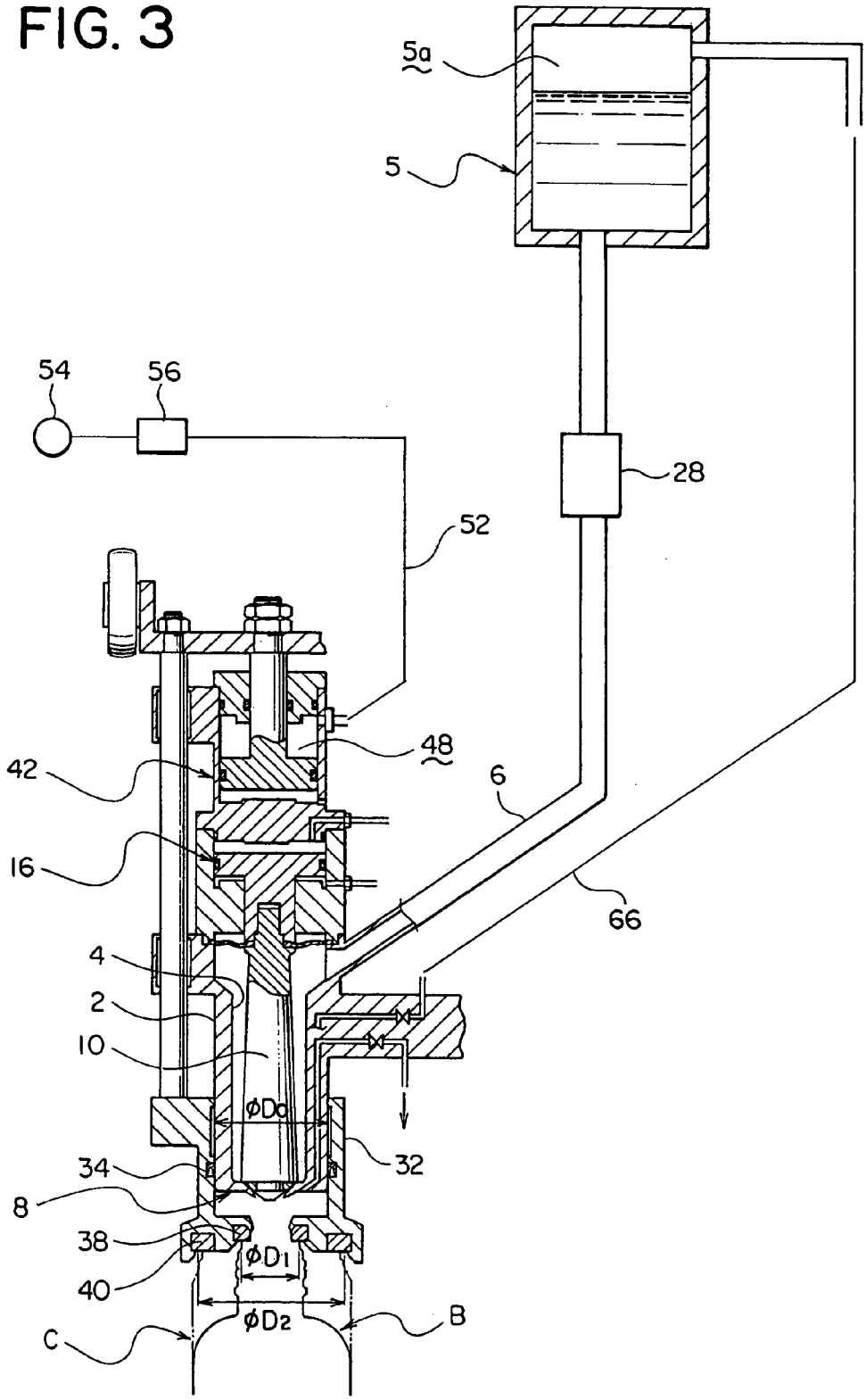
FIG. 3 is a view showing an essential part of the filler including the filling valve.
Figure 4B:
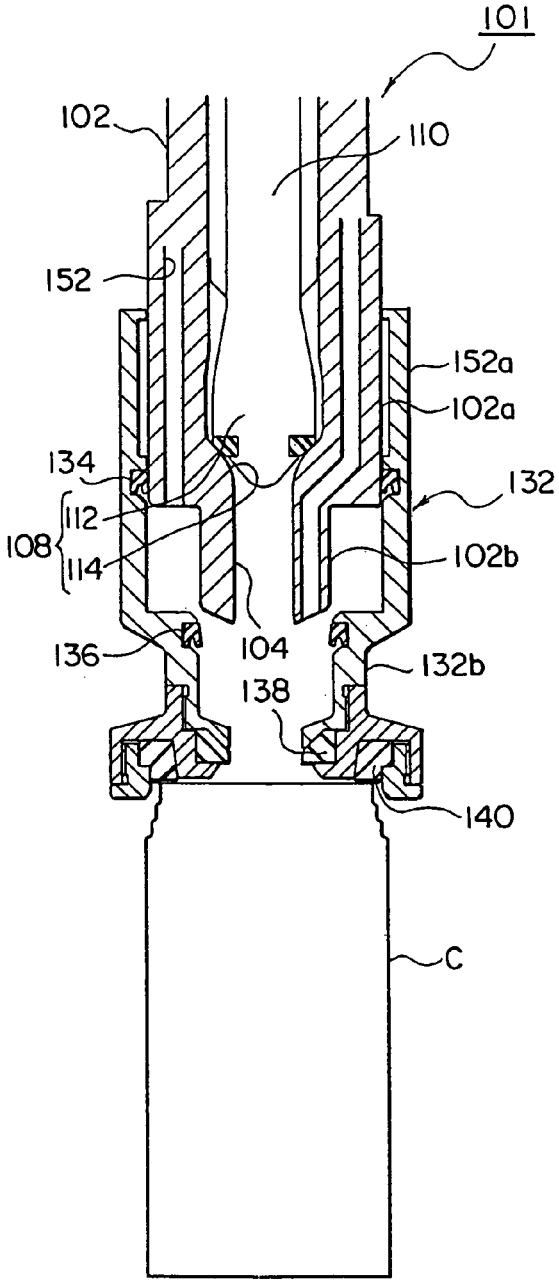
FIGS. 4A and 4B are longitudinal sections of a conventional filling valve, FIG. 4A illustrating a filling operation for a first type vessel having a shoulder and FIG. 4B showing a filling operation for a second type vessel having no shoulder.
Figure 4A:
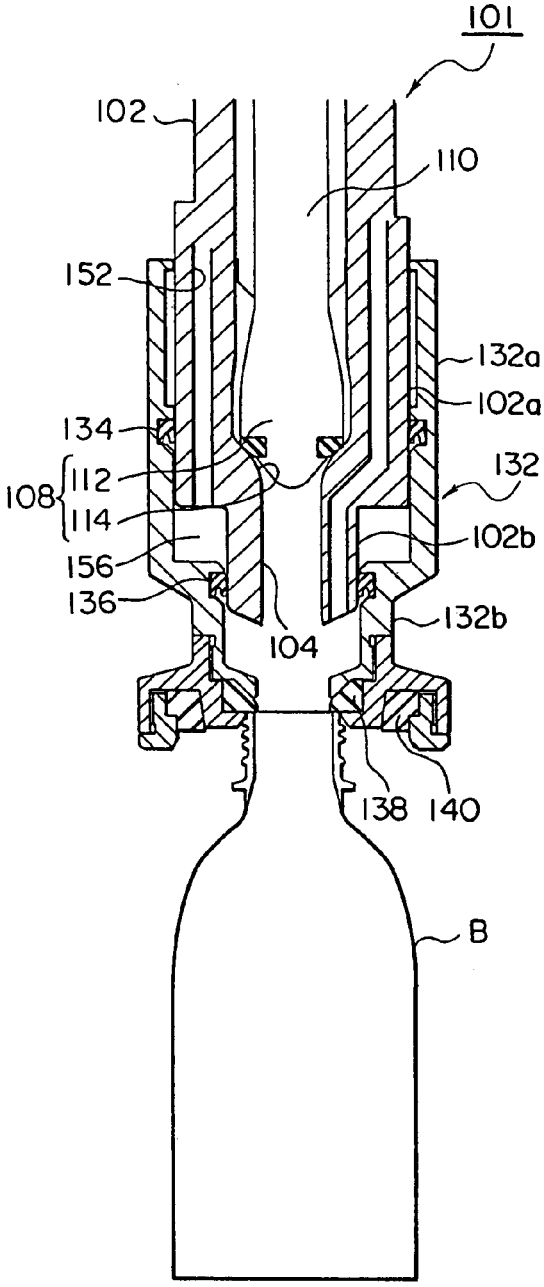

The vessel mouth gasket auxiliary air cylinder 42 comprises a piston (vessel mouth gasket auxiliary piston) 46 slidably fitted into a second cylinder housing 44 which is secured on top of the cylinder housing (first cylinder housing) 20 of the liquid valve opening and closing cylinder 16, the piston 46 dividing the interior of the second cylinder housing 44 into an upper pressure chamber 48 and a lower atmosphere chamber 50. The pressure chamber 48 is connected to a source of air pressure 54 through an air feed pipe 52, as shown in FIG. 3. In this embodiment, an auto-regulator 56 is connected with the air feed pipe 52, allowing the air pressure which is fed to the pressure chamber 48 of the air cylinder 42 to be controlled.

The auxiliary piston 46 has a rod 58 which extends upward of the second cylinder housing 44, with a horizontal plate 60 being secured toward the top end thereof. An elevating rod 62 is connected to the lower surface of the horizontal plate 60. The vessel mouth gasket unit 32 is secured to the lower end of the elevating rod 62. The elevating rod 62 is elevatably supported by guides 2*a* and 44*a* which are mounted on the outer surfaces of the valve body 2 and the second cylinder housing 44, respectively.

A cam follower 64 is mounted on the end of the horizontal plate 60, and is engaged with a cam, not shown, to allow the vessel mouth gasket unit 32 to be moved upward. During the operation of the filler G, air is normally introduced into the upper pressure chamber of the auxiliary air chamber 42, whereby the vessel mouth gasket unit 32 is urged downward through the elevating rod 62. Accordingly, in a region where the cam is provided, the vessel mouth gasket unit 32 is elevated in accordance with the locus of the cam, and in a region where the cam is not provided, it moves down to seal the mouth of the vessel B or C. In this embodiment, the cam is disposed in a region from the outlet star wheel H to the inlet star wheel F and thus when the vessel B or C is fed and discharged, the vessel mouth gasket unit 32 is forcibly moved up, thus avoiding an interference with the vessel B or C. Alternatively, air may be introduced into the upper pressure chamber 48 of the auxiliary air cylinder 42 when the vessel mouth gasket unit 32 is to be moved down, and the upper pressure chamber 48 may be made to open to the atmosphere when the gasket unit is to be moved up in accordance with the cam.

As mentioned above, the air pressure of the vessel mouth gasket auxiliary air cylinder 42 can be controlled by the auto-regulator 56, and accordingly, depending on the type of the vessel, a given pressure can be used to urge the vessel mouth gaskets 38 and 40 against the vessels B and C to seal them. Rather than controlling the air pressure by means of the auto-regulator 56, a plurality of paths can be switched by a solenoid valve, for example.

It will be noted that a pair of gas passages 66 and 68 which open into the lower end face of the valve body 2 are disposed within the valve body 2. One of the gas passages, 66, represents a counter passage, and is connected to a head space 5*a* within the tank of filled liquid 5 (a space over a reservoir of filled liquid). The other gas passage 68 represents a snifter passage, and is connected to a shifter chamber, not shown, through a snifter valve 72. In the filling valve 1 of the present embodiment, the counter passage 66 which extends through the wall of the valve body 2 is provided and connected to the head space 5*a* in the tank of filled liquid 5, and this allows a vent tube which has been provided in a conventional filling valve to be dispensed with, thus avoiding the need to change the attachment when the type of vessel is changed.

The operation of the filling valve 1 constructed in the manner mentioned above will now be described. In a gas-charged filling operation, as when a filled liquid such as a carbon dioxide gas-charged beverage is to be filled under pressure, the filled liquid is contained within the tank 5, and the pressure gas is confined into the space 5*a* located above the filled liquid.

Under this condition, vessels B or C, which are conveyed by the vessel conveyor A, are separated from each other to be spaced apart by a given spacing by means of the in-feed screw E, and is then conveyed onto the rotary filler G by the inlet star wheel F.

In the filler G, at the moment the vessel B or C is fed to a position below the filling valve 1, the vessel mouth gasket unit 32 assumes its raised position by the action of the cam, not shown, which raises the cam follower 64, and as the cam follower 64 passes through the region where the cam is provided after the vessel B or C has been fed, the supply of the air pressure to the pressure chamber 48 of the vessel mouth gasket auxiliary air cylinder 42 causes the gasket unit 32 to move down, thus sealing the vessel B or C. When the bottle-like first type vessel is to be filled, the operating pressure for the auxiliary air cylinder 42 is chosen to be a low pressure. Because the mouth of the first type vessel B has a small diameter D1, the first gasket 38 associated with the first type vessel which is mounted on the inner periphery of the vessel mouth gasket unit 32 at its bottom is brought into abutment against the mouth of the vessel B to seal it with a low load.

After the vessel B is initially sealed with a low load by the first gasket 38, the counter gas valve 70 in the counter passage 66 is opened to introduce the pressurized gas within the tank 5 into the vessel B through the counter passage 66. As long as the counter gas is being fed, the pressure of the counter gas acts on an area corresponding to the outer diameter D0 of the valve body 2 from which the aperture diameter D1 of the vessel B is subtracted, thus sealing the mouth of the vessel B. If the outer diameter D0 of the valve body 2 is too large with respect to the aperture diameter D1 of the vessel B, the load acting upon the vessel B may become excessively high to cause a buckling of the vessel B. Accordingly, it is necessary that the outer diameter D1 of the valve body 2 be determined by calculation on the basis of the pressure of the pressurized gas for the filled liquid and the durability of the vessel B.

When the counter gas is fed into the vessel B for a given time interval and the pressure within the vessel B becomes equal to the pressure within the tank 5, the liquid valve opening and closing air cylinder 6 is actuated to raise the rod 10 and its integral valve element 12, thus removing the valve element 12 from the backseat 14 to open the liquid valve.

When the liquid valve 8 is opened, the filled liquid which is fed from the tank 5 through the liquid feed pipe 6 passes through the filled liquid passage 4 disposed within the valve body 2 to fill the vessel B, and concurrently, the gas within the vessel B is discharged through the counter passage 66 to be returned to the tank 5. As mentioned previously, the liquid feed pipe 6 of the filling valve 1 is provided with the flowmeter 28, and when a given amount of filled liquid has been filled, a signal from the flowmeter 28 causes a controller, not shown, to actuate the liquid valve opening and closing air cylinder 16 to close the liquid valve 8, thus terminating the filling operation. The counter gas valve 70 disposed in the counter passage 66 is also closed.

Subsequent to the termination of the filling operation, the snifter valve 72 disposed in the snifter passage 68 is opened to release the pressurized gas from within the head space of the vessel B gradually until atmospheric pressure is reached in order to avoid an abrupt bubbling of the filled liquid when the vessel mouth gasket 38 is removed from the vessel B subsequently. Subsequently, when the filling valve 1 reaches a position where the cam, not shown, is provided, the cam follower 64, the elevating rod 62 and the vessel mouth unit 32 are raised to remove the first gasket 38 from the vessel B, and the vessel B is discharged from the filler G through the outlet star wheel H.

When a gas-charged filling operation takes place with respect to the second type vessel C having a larger aperture diameter D2 such as an open-top canister, a higher air pressure is chosen in the vessel mouth gasket auxiliary air cylinder 42. After the vessel C has been fed to a position located below the filling valve 1, as the filling valve 1 passes through a region where the cam, not shown, is provided, the air introduced into the upper pressure chamber of the vessel mouth gasket auxiliary air cylinder 42 causes the vessel mouth gasket unit 32 to move down to bring the vessel mouth gasket (second gasket) 40 associated with the second type vessel which is mounted on the lower surface of the gasket unit 32 toward the outer periphery thereof into abutment against the mouth of the vessel C to seal it. Accordingly, an initial sealing of the mouth of the vessel C takes place with a high load for the second type vessel C.

After the initial sealing of the vessel C which takes place by means of the second gasket 40, the counter gas valve 70 disposed in the counter passage 66 is opened to introduce the pressurized gas in the tank of filled liquid 5 into the vessel C. As long as the counter gas is being supplied, a reaction from below is applied to the vessel C for an area corresponding to the aperture diameter D2 of the vessel C from which the outer diameter D0 of the valve body 2 is subtracted. Accordingly, even though the urging force by the counter gas which is applied from above is insufficient to provide a satisfactory sealing force, this is supplemented by choosing a higher pressure for the vessel mouth gasket auxiliary air cylinder 42, thus securing a satisfactory sealing force.

After the counter gas has been fed into the vessel C for a given time interval, the liquid valve opening and closing air cylinder 16 is actuated to raise the rod 10 and the valve element 12, removing the valve element 12 from the valve seat 14 to open the liquid valve 8.

When the liquid valve 8 is opened, the filled liquid from the tank of filled liquid 5 is filled into the vessel C while the gas within the vessel C is discharged through the counter passage 66 to be returned to the tank 5. When a given amount of filled liquid has been filled as determined by the flowmeter 28, the liquid valve 8 is closed to terminate the filling operation. The counter gas valve 70 disposed in the counter passage 66 is also closed. Subsequent to the termination of the filling operation, the snifter valve 72 disposed in the snifter passage 68 is opened to release the pressurized gas gradually from within the head space of the vessel C until atmospheric pressure is reached. Subsequently, the cam, not shown, causes the cam follower 64, the elevating rod 62 and the vessel mouth gasket unit 32 to be raised, removing the second gasket 40 from the vessel C, which is then discharged from the filler G.

The filling valve 1 can be used not only in a gas-charged filling operation, but also in a no-gas filling operation. In this instance, the vessel mouth gasket unit 32 is moved down by the vessel mouth gasket auxiliary air cylinder 42 to bring the vessel mouth gasket 38 or 40 into close contact with the mouth of the vessel B or C to seal it while a filling operation takes place. Alternatively, a filling operation may also take place while the vessel B or C is left open.

The vessel mouth gasket unit 32 of the filling valve 1 is provided with the first gasket 38 for the bottle-like first type vessel B and the second gasket 40 for the second type vessel C having a larger aperture diameter, such as a canister, and therefore, it can be used for either type of vessel B or C. In addition, the counter passage 66 connected to the head space 5*a* of the tank of filled liquid 5 is provided to dispense with a vent tube, and accordingly, when the filling valve 1 is selectively used with the first and the second type vessel B or C, there is no need to change an attachment. It will be seen that both the first and the second type vessel B and C can be filled with a filler of a lifterless type, namely, a filler which does not include a mechanism for lifting vessels, dispensing with a vessel lifting mechanism and allowing a filling region to be laid out for an increased length, thus resulting in a reduced operation cost and an increased rate of operation. It is also to be noted that although in the embodiment described above, the first gasket 38 of a-smaller diameter which seals the bottle-like first type vessel B is disposed toward the inner periphery while the second gasket 40 of a larger diameter which seals the second type vessel C, such as a canister, is disposed toward the outer periphery on the lower surface of the vessel mouth gasket unit 32, there is no need to provide two gaskets and the required operation can be served by a single annular gasket having a greater radial width.

While in the described embodiment, a load applied to the first type vessel B and the second type vessel C is selected by switching the air pressure which is introduced into the upper pressure chamber of the auxiliary air cylinder 42 between a low pressure and a high pressure, the desired load upon either vessel B or C can be obtained by using an alternative construction. For example, a spring which urges the piston 46 downward may be disposed within the upper pressure chamber 48 of the auxiliary air cylinder 42, and the initial sealing may take place by the resilient force of the spring alone without introducing the air pressure into the upper pressure chamber 48 for filling the first type vessel B and the initial sealing of the second type vessel C may take place utilizing the spring and the air pressure by introducing the pressurized air into the upper pressure chamber 48. In this instance, there is no need to switch the air pressure introduced into the upper pressure chamber between a high pressure and a low pressure.

What is claimed is:

1. A filling valve for use with both a first type of vessel having a smaller aperture diameter and a second type of vessel having a larger aperture diameter, said filling valve comprising a valve body having a filled liquid passage formed internally therein and having an outer diameter which is greater than the aperture diameter of the first type of vessel and less than the aperture diameter of the second type of vessel, a liquid valve for opening and closing the filled liquid passage, a vessel mouth gasket unit fitted around an outer periphery of the valve body such that the vessel mouth gasket unit is movable in an elevatable manner, a seal member for sealing between the valve body and the vessel mouth gasket unit, a gasket mounted on the vessel mouth gasket unit for abutment against a mouth of the first type of vessel and a mouth of the second type of vessel, and an air cylinder for urging the vessel mouth gasket unit downward such that the gasket is urged with a greater force against the second type of vessel than against the first type of vessel when the second type of vessel is to be filled.

2. A filling valve according to claim 1, wherein the filling valve can be used in both a gas-charged filling operation and a no-gas filling operation.

3. A filling valve according to claim 1, further comprising a gas passage formed within the valve body to introduce a counter gas into the vessels during a gas-charged filling operation and for discharging the gas during a filling operation.

4. A filling valve according to claim 1, wherein the vessel mouth gasket unit includes a first gasket of a smaller diameter for the first type of vessel and a second gasket of a larger diameter for the second type of vessel.

* * * * *